US011069995B1

(12) United States Patent
Hack et al.

(10) Patent No.: US 11,069,995 B1
(45) Date of Patent: Jul. 20, 2021

(54) SINGLE SELF-INSULATING CONTACT FOR WET ELECTRICAL CONNECTOR

(71) Applicant: Northrop Grumman Systems Corporation, Falls Church, VA (US)

(72) Inventors: Harvey P. Hack, Arnold, MD (US); James R. Windgassen, Chester, MD (US)

(73) Assignee: Northrop Grumman Systems Corporation, Falls Church, VA (US)

( * ) Notice: Subject to any disclaimer, the term of this patent is extended or adjusted under 35 U.S.C. 154(b) by 0 days.

(21) Appl. No.: 16/784,518

(22) Filed: Feb. 7, 2020

(51) Int. Cl.
*H01R 13/52* (2006.01)
*H01R 13/03* (2006.01)
*H01R 13/523* (2006.01)

(52) U.S. Cl.
CPC ..... *H01R 13/03* (2013.01); *H01R 13/523* (2013.01)

(58) Field of Classification Search
CPC ..... H01R 13/03; H01R 13/523
USPC ..... 439/524
See application file for complete search history.

(56) References Cited

U.S. PATENT DOCUMENTS 3,751,296 A 8/1973 Beer
4,278,508 A * 7/1981 White ..... G01N 21/91 205/776.5
4,474,623 A * 10/1984 Adlerstein ..... H01L 21/26586 257/626
4,515,673 A * 5/1985 Hayfield ..... C23F 13/02 204/196.36
4,535,343 A * 8/1985 Wright ..... B41J 2/14129 347/64
5,772,457 A 6/1998 Cairns
6,511,335 B1 1/2003 Rayssiguier et al.
7,261,394 B2 * 8/2007 Silverbrook ..... B41J 2/1404 347/56
7,381,105 B2 * 6/2008 Miekka ..... H01R 13/02 439/886
7,731,515 B2 6/2010 Nicholson
(Continued)

FOREIGN PATENT DOCUMENTS

CA 1128621 A 7/1982
EP 0010382 B1 7/1983

OTHER PUBLICATIONS

International Search Report and Written Opinion received in international application No. PCT/US2021/13533, dated May 18, 2021 (15 pages).

*Primary Examiner* — Abdullah A Riyami
*Assistant Examiner* — Vladimir Imas
(74) *Attorney, Agent, or Firm* — Edell, Shapiro & Finnan, LLC

(57) ABSTRACT

An electrical connector includes an electrically insulating body and a self-passivating contact held at a higher voltage than a non-passivating contact. The self-passivating contact includes a first electrically conductive material that forms an electrically insulating passivation layer when exposed to water or other aggressive environment. The non-passivating contact includes a second electrically conductive material that is unreactive when exposed to water or other aggressive environment. The passivation layer on the self-passivating contact prevents electric current from flowing between the self-passivating contact and the non-passivating contact through the water or other aggressive environment.

20 Claims, 5 Drawing Sheets

(56) References Cited

U.S. PATENT DOCUMENTS

| | | | | |
|---|---|---|---|---|
| 8,226,807 | B2 * | 7/2012 | Abys | C25D 3/30 205/109 |
| 9,197,006 | B2 | 11/2015 | Hack | |
| 9,557,289 | B2 * | 1/2017 | Cobianu | G01N 27/404 |
| 9,893,460 | B2 | 2/2018 | Windgassen | |
| 10,868,384 | B1 * | 12/2020 | Windgassen | H01R 4/62 |
| 2015/0011107 | A1 | 1/2015 | Hack | |
| 2016/0233607 | A1 | 8/2016 | Windgassen et al. | |

* cited by examiner

SINGLE SELF-INSULATING CONTACT FOR WET ELECTRICAL CONNECTOR

FIELD OF INVENTION

The present invention relates to electrical connectors in adverse environments.

BACKGROUND

Electrical connectors for use in harsh environments are typically designed to exclude the environment from the electrical contacts to prevent the environment from degrading the contact material or shorting connected electronics. The harsh environment may degrade the electrical contact by corroding the electrical contact or otherwise reacting with the electrical contact. In one example, the electrical connector may use a set of gaskets, seals, and/or oil filled bladders to exclude the environment from the electrical contacts. Additional precautions may be taken for wet environments that provide a conduction path outside of the intended electrical connection. The outside conduction path may provide an additional method of corrosion of the electrical contact, further degrading the electrical connection.

In one example of conventional connectors, the contact material may be formed from a relatively exotic material that does not react with the expected environment, or reacts with the expected environment in a predictable and manageable way. However, connectors with exotic materials and/or complex sealing systems may incur additional costs to manufacture and/or service. Additionally, some exotic materials may have undesirable properties, such as brittleness, that present additional issues with manufacturing and/or using the electrical connector.

SUMMARY

The techniques presented herein provide for an electrical connector comprising an electrically insulating body and a self-passivating contact held at a higher voltage than a non-passivating contact. The self-passivating contact comprises a first electrically conductive material that forms an electrically insulating passivation layer when exposed to water. The non-passivating contact comprises a second electrically conductive material that may or may not form a passivation layer when exposed to water.

DETAILED DESCRIPTION

Figure 1:
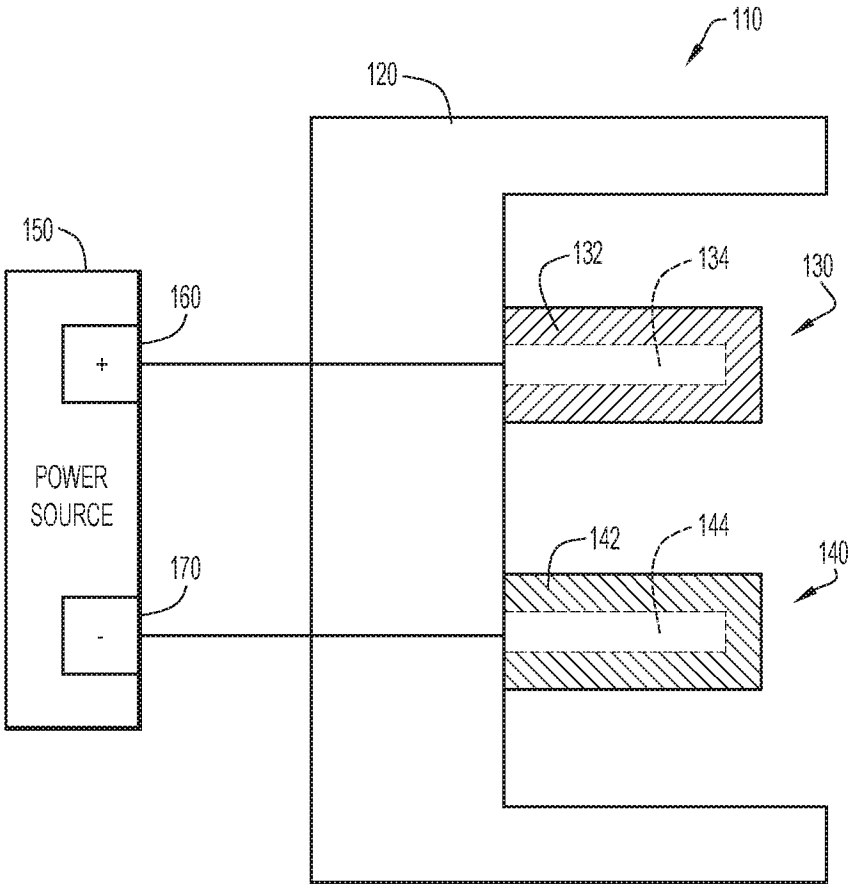
FIG. 1 is a simplified diagram of an electrical connector according to one embodiment.

The use of self-passivating material in contacts for electrical connectors in adverse environments, such as an underwater environment, provides an important tool for protecting against corrosion driven by an applied voltage between the contacts of the electrical connector. As described herein, contacts are electrically conducting materials that are formed to make electrical connections with other contacts in, e.g., another electrical connector. More specifically, an anodic contact, or anode, is used to describe a contact that is held at a higher electric potential than a cathodic contact, or cathode, in the same environment. Holding the anode at a higher electric potential biases the material in the anode to be oxidized by the environment, and the material in the cathode to be reduced by the environment. Self-passivating materials typically react with an adverse environment by forming a thin passivation layer on the surface of the material. In one example, the self-passivating material may react with water, either liquid or vapor, in the adverse environment to form the passivation layer. The passivation layer is typically non-reactive with the environment and protects the bulk of the material from further reactions with the environment. In another example, the self-passivating material may be electrically conductive, while the passivation layer may be electrically insulating to prevent electrical conduction through the self-passivating material into the adverse environment.

Some examples of materials that are self-passivating in water include niobium, tantalum, titanium, zirconium, molybdenum, ruthenium, rhodium, palladium, hafnium, tungsten, rhenium, osmium, and iridium. Each of these materials react with water to form an electrically insulating passivation layer when exposed to a water environment. The passivation layer may be oxides, hydroxides, or other compounds that form by reacting the self-passivating material with an adverse environment. Self-passivating materials may also be more expensive than other materials, such as copper, which are typically used for electrical contacts.

While the anodic (i.e., positive) contact in an electrical connector may be formed from a self-passivating material to protect against corrosion driven by the applied voltage, the cathodic (i.e., negative) contact does not necessarily have to be made from the same self-passivating material. Since the electrically driven corrosion occurs at the anode, the cathode may be formed from any suitable material that has sufficient corrosion resistance in the intended use environment to perform adequately over the anticipated lifetime. For instance, the cathode may be formed from copper, silver, gold, platinum, aluminum, or alloys thereof. Alternatively, the cathode may be made of a non-metallic conductor, such as graphite. Allowing greater material selection options for the cathode may reduce cost and improve design flexibility.

Some self-passivating metals used for electrical contacts are much more expensive than traditional metals used for electrical contacts. For instance, niobium is approximately ten times as expensive as a copper alloy such as copper-beryllium (e.g., Unified Numbering System (UNS) C17200) commonly used for contacts in electrical contacts. Use of a copper alloy for the cathode would significantly reduce the cost of the raw materials in the electrical connector. Additionally, niobium is soft and gummy to machine, whereas copper alloys can be harder materials that are easier to machine, resulting in lower manufacturing costs. Further, some self-passivating materials may have a lower electrical conductivity than traditional electrical contact materials. Forming the cathode from traditional electrical contact material, such as a copper alloy, may allow for the use of a smaller contact than if that contact were made from a self-passivating material, such as niobium, further reducing the cost of the overall electrical connector.

Referring now to FIG. 1, an example of an electrical connector 110 is shown. The electrical connector 110 includes a connector body 120 to provide structure and separation for the electrical contacts. The connector body 120 may be formed of an electrically insulating material such as, e.g., plastic or rubber. The electrical connector 110 also includes an anode 130 formed from a self-passivating material 132. The anode 130 may be formed with the self-passivating material 132 plated over an optional inner contact made from a different material 134. The electrical connector 110 includes a cathode 140 formed from a non-passivating material 142. The cathode may be formed with the non-passivating material 142 plated over an optional inner contact formed from a different material 144. Examples of how the anode 130 and/or the cathode 140 may be formed are shown and/or described in U.S. patent application Ser. No. 16/434,283, filed on Jun. 7, 2019, the disclosure of which is incorporated by reference herein.

A power source 150 applies a voltage to the contacts 130, 140 of the electrical connector 110, and may supply power to a load that is connected through the electrical connector 110. The power source 150 includes a positive terminal 160 connected to the anode 130 and a negative terminal 170 connected to the cathode 140. In one example, the power source 150 provides a static voltage difference between the positive terminal 160 and the negative terminal 170. Alternatively, the voltage difference between the positive terminal 160 and the negative terminal 170 may vary with time, for instance, to convey information through the electrical connector 110. Examples of other power sources suitable for use with the contacts described herein are shown and/or described in U.S. patent application Ser. No. 16/200,147, filed on Nov. 26, 2018, the disclosure of which is incorporated by reference herein.

The electrical connector 110 is shown in FIG. 1 as a two-pin electrical connector configured to mate with a two-socket electrical connector (e.g., as described below with reference to FIG. 3), but other configurations of electrical connectors may also be used with the techniques described herein. For example, the electrical connector can have more than two pins. Additionally, the electrical connector may include contacts in various shapes, e.g., blades, plates, blocks, posts, rungs, spades, clips, slots, coaxial connections, or combinations of the foregoing. Further, the electrical connector may include both protruding contacts (e.g., pins, blades, etc.) and receiving contacts (e.g., slots, receptacles, etc.) in the same electrical connector. In general, the techniques described herein may be applied to an electrical connector with contacts in any combination of pins, holes, plates, slots, protrusions, or receptacles.

Figure 2:
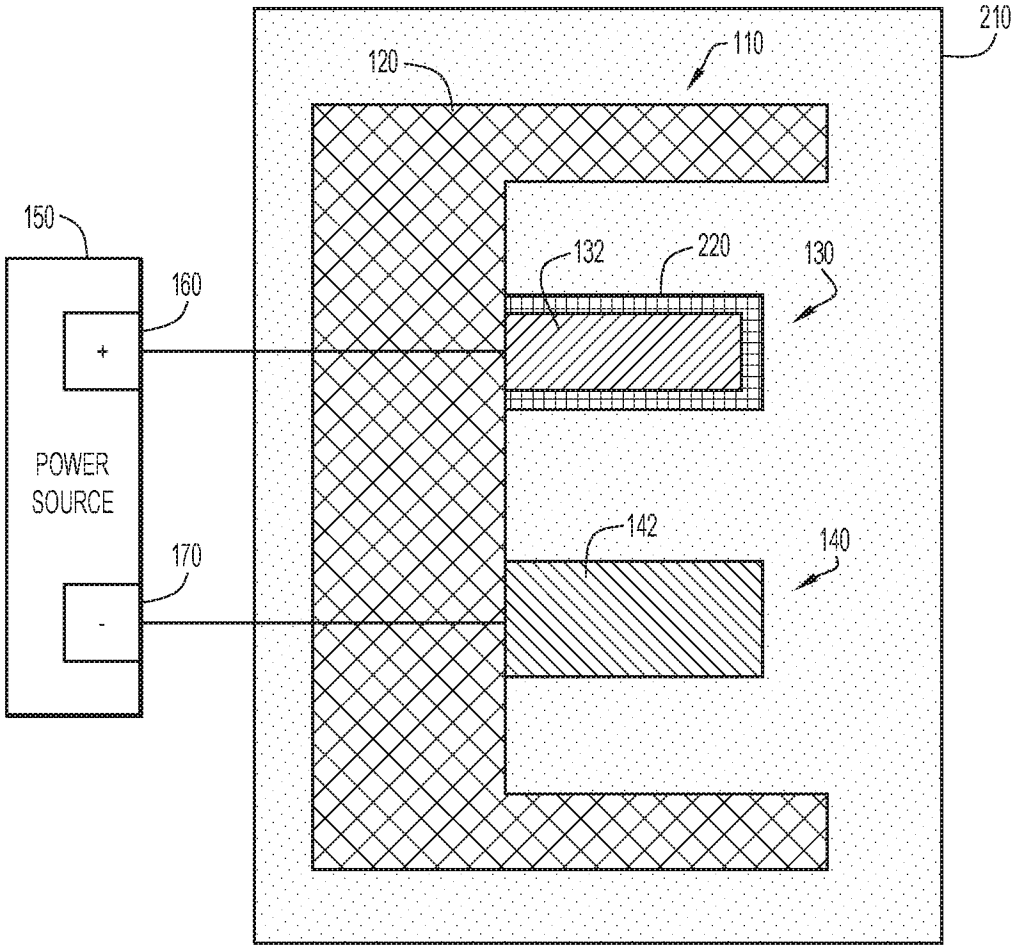
FIG. 2 illustrates an electrical connector according to one embodiment when exposed to a water environment.

Referring now to FIG. 2, the electrical connector 110 is shown in an adverse environment 210. In one example, the adverse environment 210 may be fully submerged under water or an electrolytic solution that conducts electricity. Alternatively, the adverse environment 210 may include water vapor and/or periodic exposure to liquid water. For instance, in a marine environment the electrical connector 110 may be exposed to seawater by being fully submerged or through splashing and spraying of the seawater.

When the electrical connector 110 is connected to a power source (e.g., power source 150) as described above and exposed to the adverse environment 210, the anode 130, which includes at least an outer cladding of self-passivating material 132, reacts with the environment 210 to form a passivation layer 220. The cathode 140, which is formed from non-passivating material 142 does not react with the environment 210. The passivation layer 220 is electrically insulating and prevents the voltage applied by the power source 150 from pushing current through the environment 210. In one example, the passivation layer 220 may be an oxide or other compound formed from the self-passivating material 132. For instance, the self-passivating metal 132 may be niobium metal and the passivation layer 220 may be an oxide of niobium, such as $Nb_2O_5$.

Figure 3:
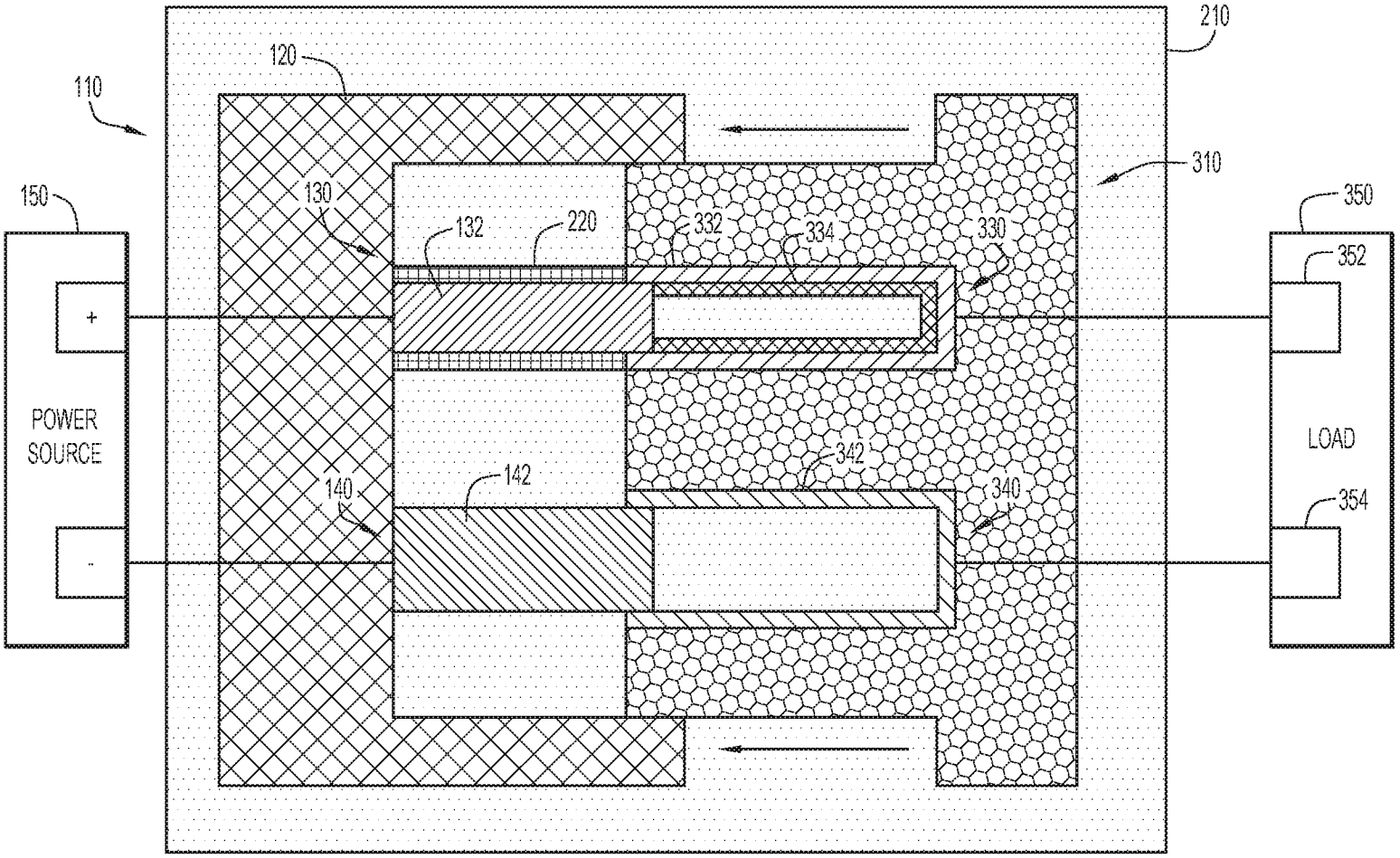
FIG. 3 is a simplified diagram of one embodiment of mating electrical connectors when exposed to a water environment.

Referring now to FIG. 3, an example of making an electrical connection between two mating electrical connectors in an adverse environment is shown. To connect to the electrical connector 110, as described with respect to FIG. 1 and FIG. 2, a complementary electrical connector 310 is provided. The electrical connector 310 includes a connector body 320 that is configured to fit with the connector body 120 of the electrical connector 110. The electrical connector 310 also includes a positive electrode 330 formed from a self-passivating material 332, which forms a passivation layer 334 in the adverse environment 210. The positive electrode 330 is configured to match the positive anode 130 of the electrical connector 110. The second connector 310 may be formed of the same materials as the first connector 110. More specifically, in one example, the self-passivating material 332 may be the same material as the self-passivating material 132 to reduce galvanic corrosion between dissimilar metals. Dissimilar metals may also be used for self-passivating materials 332 and 132 to reduce galling that can occur between similar metals when in sliding contact.

The electrical connector also includes a negative electrode 340 formed from a non-passivating material 342. The negative electrode 340 is configured to match the negative cathode 140 of the electrical connector 110. In one example, the non-passivating material 342 is the same material as the non-passivating material 142 to reduce galvanic corrosion between dissimilar metals. Dissimilar metals may also be used for materials 342 and 142 to reduce galling that can occur between similar metals when in sliding contact. Similar to the positive anode 130 and the negative cathode 140 described with respect to FIG. 1, the positive electrode 330 and/or the negative electrode 340 may be formed with an underlying structure that is plated with the self-passivating material 332 and non-passivating material 342, respectively.

The electrical connector 310 is shown connected to a load 350, with the positive electrode 330 being connected to a first terminal 352 and the negative electrode 340 being connected to a second terminal 354. The load 350 may include one or more electrical circuits configured to receive power and/or communication signals via the electrical connector 310.

In one example, the action of mating the electrical connector 110 with the electrical connector 310 acts to physically scrape the passivation layers 220 and 334 from the electrodes 130 and 330, respectively, to bring the electrodes into good electrical contact with each other. During the processing of connecting the two electrical connectors, the adverse environment 210 may be expelled from the shrinking space between the respective electrodes and between the respective connector bodies through vent holes (not shown). However, there is no need to exclude the adverse environment 210 as long as the form of the connector bodies and/or electrodes allow for sufficient electrical contact between the respective electrodes.

Figure 4:
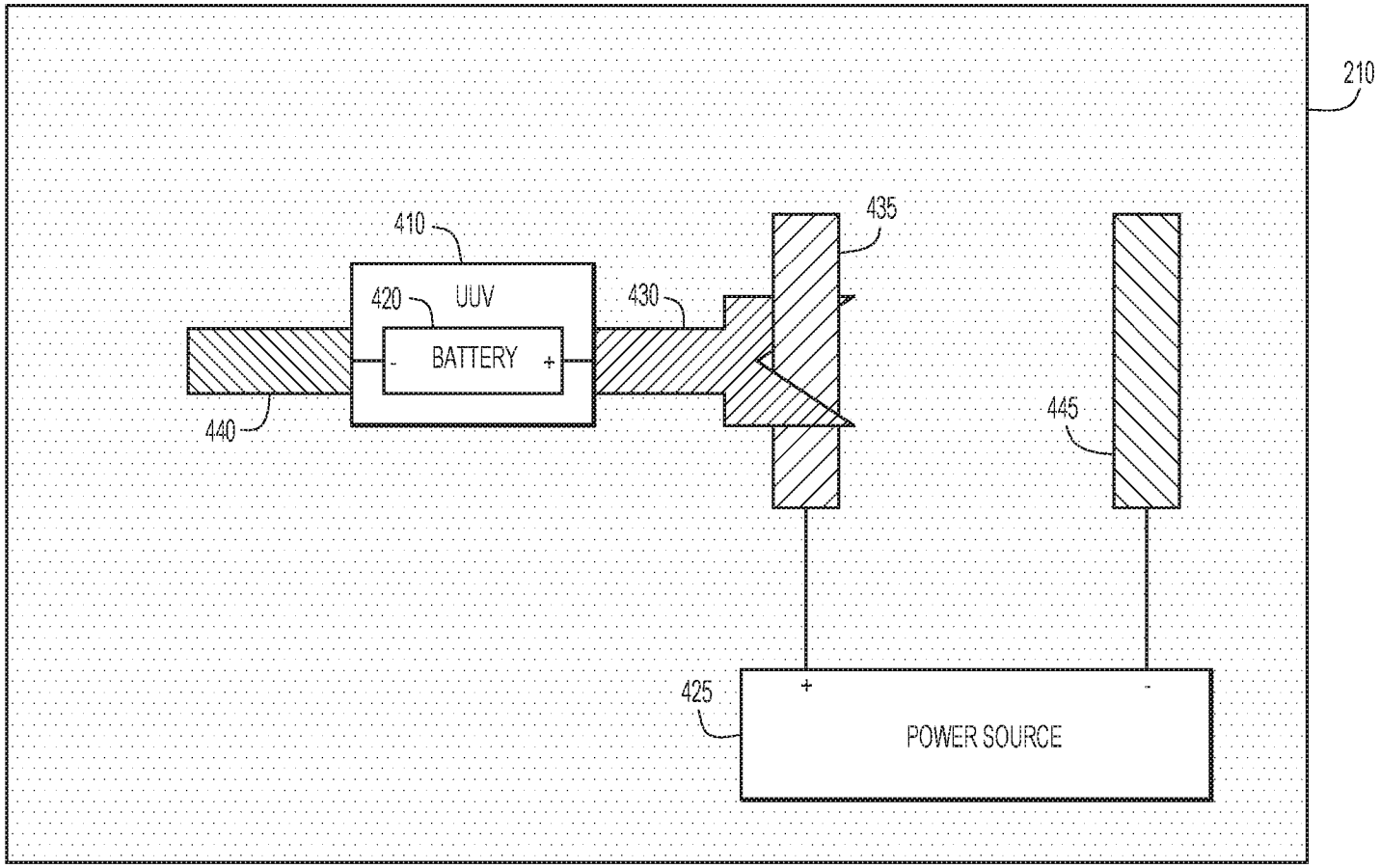
FIG. 4 is a simplified diagram of one example of an electric connector using a seawater electrical return.

Referring now to FIG. 4, a specific example of a system using an electrical connector in an electrically conductive environment 210, such as seawater. In this example, an Unmanned Underwater Vehicle (UUV) 410 is depicted recharging an onboard battery 420 from an underwater power source 425. The positive terminal of the battery 420 is connected to an anode 430 extending from the UUV 410. The anode 430 is formed from a self-passivating material, such as niobium. The anode 430 is formed into a shape that is configured to capture a positive terminal 435 by moving the UUV 410 in the conductive environment 210. For instance, the anode 430 may be formed as two connected prongs that are configured to straddle the positive terminal 435.

The negative terminal of the battery 420 is connected to a seawater ground electrode 440 that extends from the UUV 410 into the electrically conductive environment 210. The electrically conductive environment 210 allows current to flow through the conductive environment 210 from the seawater ground electrode 440 to a complementary seawater ground electrode 445 that is connected to the negative terminal of the power source 425 as an electrical return. The seawater ground electrode 440 and the complementary seawater ground electrode 445 may be made from corrosion-resistant material, such as graphite, mixed metal oxides, or noble metals.

In the example shown in FIG. 4, a self-passivating material is used for the anodic connection of the UUV 410 to the power source 425, and a seawater electrical return runs through the seawater ground electrode 440 of the UUV 410 through the conductive environment 210 to the complementary seawater ground electrode 445 and then to back to the power source 425 to complete the electrical circuit This arrangement allows for a simple exposed rod or wire of a self-passivating material, such as niobium, in seawater to serve as a mechanism for charging an undersea system, such as a UUV. The connection may also be used to transfer data between the UUV and the power source.

Figure 5:
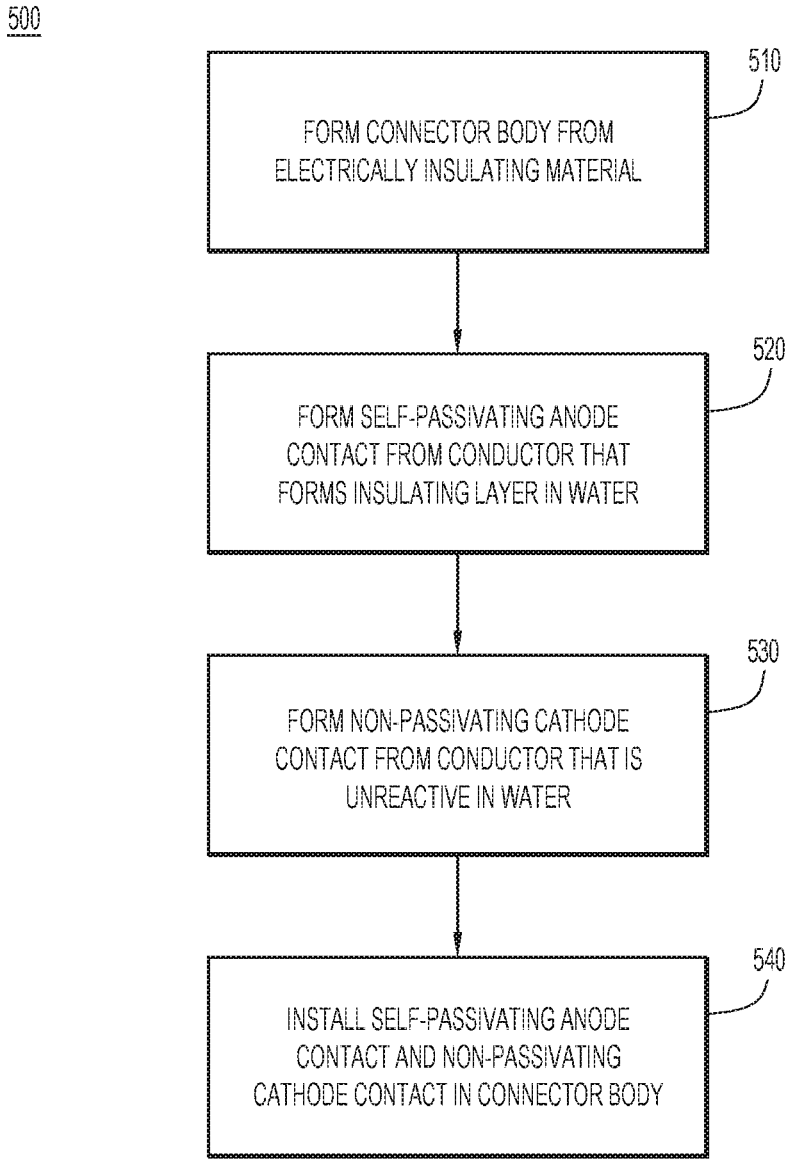
FIG. 5 is a flowchart of an example of a manufacturing process for producing an electrical connector according to one embodiment.

Referring now to FIG. 5, a flowchart illustrates an example process 500 to manufacture an electrical connector (e.g., electrical connector 110) according to the techniques described herein. At 510, a connector body is formed from an electrically insulating material. In one example, the connector body may be formed by plastic injection into a suitable mold. The electrically insulating material may be selected according to an expected use environment to ensure that the connector body does not degrade in an adverse environment. In another example, the connector body may be formed with openings to accommodate electrodes.

At 520, a self-passivating anode contact is formed from an electrically conducting material that forms a passivation layer when exposed to an expected use environment. In one example, the self-passivating material may be a transition metal, such as niobium or titanium, which forms an electrically insulating oxide or other compound when exposed to water. In another example, the self-passivating electrically conductive material is plated on a different electrically conductive material, which may be less expensive or easier to manufacture. In yet another example, the self-passivating anode contact may be formed as a pin, plate, hole, slot, protrusion or receptacle.

At 530, a non-passivating cathode contact is formed from an electrically conductive material that is unreactive to the environment in which the electrical connector is expected to be used. In one example, the electrically conductive material of the non-passivating cathode contact may be copper or a copper alloy, which is inexpensive and simpler to machine than the electrically conductive material of the self-passivating anode contact. In another example, the non-passivating cathode contact may be formed as a pin, plate, hole, slot, protrusion, or receptacle.

In one example, the manufacturing technique for forming the self-passivating anode may differ from the manufacturing technique for forming the non-passivating cathode, for example, due to the differing materials. For instance, niobium is relatively soft, which presents challenges to machining, but may be easily cut with an electric discharge machine. Additionally, niobium presents significant obstacles to chemical etching, but copper may be easily etched to form a contact.

At 540, the self-passivating anode contact and the non-passivating cathode contact are installed in the connector body to form the electrical connector. The anode/cathode contacts may be formed separately from the connector body and joined to the connector body, e.g., by being press fit into the body. Alternatively, the anode/cathode contacts may be formed within the connector body.

In summary, the techniques described herein provide for the use of a self-passivating material for only the anodic (positive) contact of an electrical connector for use in adverse, e.g., underwater, environments. Enabling one of the two contacts in the electrical connector to be made from a self-passivating metal while the other contact is made from any corrosion-resistant electrical conductor lowers the cost and opens the design space for underwater electrical connectors.

Methods and systems are disclosed herein with the aid of functional building blocks illustrating functions, features, and relationships thereof. At least some of the boundaries of these functional building blocks have been arbitrarily defined herein for the convenience of the description. Alternate boundaries may be defined so long as the specified functions and relationships thereof are appropriately performed. While various embodiments are disclosed herein, it should be understood that they are presented as examples. The scope of the claims should not be limited by any of the example embodiments disclosed herein.

What has been described above are examples. It is, of course, not possible to describe every conceivable combination of components or methodologies, but one of ordinary skill in the art will recognize that many further combinations and permutations are possible. Accordingly, the disclosure is intended to embrace all such alterations, modifications, and variations that fall within the scope of this application, including the appended claims. As used herein, the term "includes" means includes but not limited to, the term "including" means including but not limited to. The term "based on" means based at least in part on. Additionally, where the disclosure or claims recite "a," "an," "a first," or "another" element, or the equivalent thereof, it should be interpreted to include one or more than one such element, neither requiring nor excluding two or more such elements.

What is claimed is:

1. An electrical connector connected to a power source, the electrical connector comprising:

an electrically insulating body;

a self-passivating contact comprising a first electrically conductive material that forms an electrically insulating passivation layer when exposed to water; and a non-passivating contact comprising a second electrically conductive material that is unreactive when exposed to water, wherein the self-passivating contact is held at a higher voltage than the non-passivating contact by the power source.

2. The electrical connector of claim 1, wherein the first electrically conductive material includes a transition metal, and the electrically insulating passivation layer is an oxide formed from the transition metal.

3. The electrical connector of claim 2, wherein the first electrically conductive material is an outer layer of the self-passivating contact.

4. The electrical connector of claim 2, wherein the transition metal is selected from a group containing niobium, tantalum, titanium, zirconium, molybdenum, ruthenium, rhodium, palladium, hafnium, tungsten, rhenium, osmium, and iridium.

5. The electrical connector of claim 1, wherein the second electrically conductive material is resistant to corrosion in an aqueous environment.

6. The electrical connector of claim 5, wherein the second electrically conductive material includes copper, silver, gold, platinum, graphite, or aluminum.

7. The electrical connector of claim 1, wherein the electrically insulating passivation layer prevents electrical current from flowing from the self-passivating contact to the non-passivating contact when exposed to water.

8. A system comprising:

a first electrical connector comprising:

a first self-passivating contact formed with a self-passivating electrically conductive material that forms an electrically insulating passivation layer when exposed to water; and a first non-passivating contact formed with a non-passivating, electrically conductive material that is unreactive when exposed to water;

a second electrical connector comprising:

a second self-passivating contact configured to mate with the first self-passivating contact, the second self-passivating contact formed with the self-passivating electrically conductive material; and a second non-passivating contact configured to mate with the first non-passivating contact, the second non-passivating contact formed with the non-passivating, electrically conductive material; and a power source configured to hold the first self-passivating contact at a higher voltage than the first non-passivating electrode.

9. The system of claim 8, wherein the self-passivating, electrically conductive material includes a transition metal, and the electrically insulating passivation layer is an oxide formed from the transition metal.

10. The system of claim 9, wherein the transition metal is selected from a group containing niobium, tantalum, titanium, zirconium, molybdenum, ruthenium, rhodium, palladium, hafnium, tungsten, rhenium, osmium, and iridium.

11. The system of claim 8, wherein the non-passivating, electrically conductive material is resistant to corrosion in an aqueous environment.

12. The system of claim 11, wherein the non-passivating, electrically conductive material includes copper, silver, gold, platinum, graphite, or aluminum.

13. The system of claim 8, wherein the electrically insulating passivation layer prevents electrical current from flowing from the first self-passivating contact to the first non-passivating contact when exposed to water.

14. The system of claim 8, wherein the second self-passivating contact is configured to scrape at least a portion of the electrically insulating passivation layer when mating with the first self-passivating contact, enabling current to flow between the first self-passivating contact and the second self-passivating contact.

15. A method comprising:

forming a connector body from an electrically insulating material;

forming a self-passivating anode comprising a first electrically conductive material that forms an electrically insulating passivation layer when exposed to water; and forming a non-passivating cathode comprising a second electrically conductive material that is unreactive when exposed to water; and installing the self-passivating anode and the non-passivating cathode in the connector body, wherein the electrically insulating passivation layer prevents electrical current from flowing from the self-passivating anode to the non-passivating cathode when exposed to water.

16. The method of claim 15, wherein forming the self-passivating anode comprises forming a transition metal as the first electrically conductive material, and wherein the electrically insulating passivation layer is an oxide formed from the transition metal.

17. The method of claim 16, wherein forming the self-passivating anode comprises selecting the transition metal from a group containing niobium, tantalum, titanium, zirconium, molybdenum, ruthenium, rhodium, palladium, hafnium, tungsten, rhenium, osmium, and iridium.

18. The method of claim 15, wherein forming the self-passivating anode comprises coating an anode formed from the second electrically conductive material with a layer of the first electrically conductive material.

19. The method of claim 15, wherein forming the non-passivating cathode comprises forming a metal that is resistant to corrosion in an aqueous environment as the second electrically conductive material.

20. The method of claim 19, wherein forming the non-passivating cathode comprises selecting the second electrically conductive material to include copper, silver, gold, platinum, graphite, or aluminum.

* * * * *